US005866993A

United States Patent [19]

Moisin

[11] Patent Number: 5,866,993

[45] Date of Patent: Feb. 2, 1999

[54] THREE-WAY DIMMING BALLAST CIRCUIT WITH PASSIVE POWER FACTOR CORRECTION

[75] Inventor: Mihail S. Moisin, Brookline, Mass.

[73] Assignee: Pacific Scientific Company, Washington, D.C.

[21] Appl. No.: 749,106

[22] Filed: Nov. 14, 1996

[51] Int. Cl.[6] ..... G05F 1/00

[52] U.S. Cl. ..... 315/307; 315/247; 315/224; 315/209 R; 315/244; 315/DIG. 4

[58] Field of Search ..... 315/307, 247, 315/291, 224, 209 R, 244, 345, DIG. 4, DIG. 7, 226, 200 R; 323/221, 222, 229, 354; 363/89, 24, 44–46

[56] References Cited

U.S. PATENT DOCUMENTS

| | | | |
|---|---|---|---|
| 2,505,112 | 7/1950 | Hallman | 173/328 |
| 2,966,602 | 12/1960 | Waymouth et al. | 313/44 |
| 3,112,890 | 12/1963 | Snelling | 240/51.11 |
| 3,517,259 | 6/1970 | Dotto | 315/200 |
| 3,569,817 | 3/1971 | Boehringer | 307/107 X |
| 3,611,021 | 10/1971 | Wallace | 315/239 |
| 3,736,496 | 5/1973 | Lachocki | 323/22 T |
| 3,882,356 | 5/1975 | Stehlin | 315/205 |
| 3,913,000 | 10/1975 | Cardwell, Jr. | 321/2 |
| 3,965,345 | 6/1976 | Fordsmand | 240/47 |
| 3,974,418 | 8/1976 | Fridrich | 315/59 |
| 4,005,334 | 1/1977 | Andrews | 315/208 |
| 4,016,451 | 4/1977 | Engel | 315/158 |
| 4,053,813 | 10/1977 | Kornrumpf et al. | 315/206 |
| 4,125,767 | 11/1978 | Silver | 250/214 D |
| 4,127,795 | 11/1978 | Knoll | 315/210 |
| 4,127,798 | 11/1978 | Anderson | 315/209 R |
| 4,135,116 | 1/1979 | Smith | 315/158 |
| 4,160,288 | 7/1979 | Stuart et al. | 363/41 |
| 4,168,453 | 9/1979 | Gerhard et al. | 315/225 |
| 4,230,971 | 10/1980 | Gerhard et al. | 315/307 |
| 4,237,403 | 12/1980 | Davis | 315/98 |

(List continued on next page.)

FOREIGN PATENT DOCUMENTS

| | | |
|---|---|---|
| 0114370 | 8/1984 | European Pat. Off. . |
| 0127101 | 12/1984 | European Pat. Off. . |
| 0239863 | 10/1987 | European Pat. Off. . |
| 0395776 | 11/1990 | European Pat. Off. . |
| 0441253 | 8/1991 | European Pat. Off. . |
| 3437554 | 4/1986 | Germany . |
| 0259646 | 3/1988 | Germany . |
| 3632272 | 4/1988 | Germany . |
| 3813672 | 11/1988 | Germany . |
| 655042 | 12/1976 | U.S.S.R. . |
| 9000830 | 1/1990 | WIPO . |
| 9009729 | 8/1990 | WIPO . |
| 9309649 | 5/1993 | WIPO . |
| 94/27420 | 11/1994 | WIPO . |

OTHER PUBLICATIONS

Kröning, et al., "New Electronic Control Gear," *Siemens Power Engineering & Automation VII*, No. 2, pp. 102–104 1985.

Hayt, et al., *Engineering Circuit Analysis*, 3d ed., pp. 296–297, 1978.

OSRAM Delux® compact fluorescent lamps, "Economical long–life lighting—with extra convenience of electronic control gear", pp. 1–15.

Philips Lighting, "Lamp specification and application guide", pp. 1, 11, 61–64, 78.

*Primary Examiner*—Don Wong
*Assistant Examiner*—Haissa Philogene
*Attorney, Agent, or Firm*—Knobbe, Martens, Olson & Bear, LLP

[57] ABSTRACT

An improved ballast circuit controls the power delivered to a three-way dimmable fluorescent lamp for use in European countries and elsewhere where the input voltage is on the order of 220 volts. The ballast circuit comprises passive power factor correction to increase the overall power factor of the circuit to above 95% while also reducing the total harmonic distortion to less than 20%. Adaptations to connect a fluorescent lamp to a three-wire dimming switch are also included.

1 Claim, 3 Drawing Sheets

U.S. PATENT DOCUMENTS

| | | | |
|---|---|---|---|
| 4,245,285 | 1/1981 | Weiss | 363/17 |
| 4,284,925 | 8/1981 | Bessone et al. | 315/240 |
| 4,348,615 | 9/1982 | Garrison et al. | 315/219 |
| 4,350,891 | 9/1982 | Wuerflein | 378/110 |
| 4,353,009 | 10/1982 | Knoll | 315/220 |
| 4,370,600 | 1/1983 | Zansky | 315/244 |
| 4,379,254 | 4/1983 | Hurban | 315/291 |
| 4,383,204 | 5/1983 | Roberts | 315/291 |
| 4,388,563 | 6/1983 | Hyltin | 315/205 |
| 4,392,087 | 7/1983 | Zansky | 315/219 |
| 4,393,323 | 7/1983 | Hubner | 313/110 |
| 4,395,660 | 7/1983 | Waszkiewicz | 315/291 |
| 4,398,130 | 8/1983 | McFadyen et al. | 315/226 |
| 4,399,391 | 8/1983 | Hammer et al. | 315/244 |
| 4,423,348 | 12/1983 | Greiler | 313/113 |
| 4,443,740 | 4/1984 | Goralnik | 315/284 |
| 4,481,460 | 11/1984 | Kröning et al. | 323/266 |
| 4,510,400 | 4/1985 | Kiteley | 307/66 |
| 4,523,131 | 6/1985 | Zansky | 315/307 |
| 4,533,986 | 8/1985 | Jones | 363/17 |
| 4,544,863 | 10/1985 | Hashimoto | 315/209 R |
| 4,547,706 | 10/1985 | Krummel | 315/226 |
| 4,562,383 | 12/1985 | Kerscher et al. | 315/225 |
| 4,580,080 | 4/1986 | Smith | 315/199 |
| 4,612,479 | 9/1986 | Zansky | 315/194 |
| 4,613,934 | 9/1986 | Pacholok | 363/131 |
| 4,616,158 | 10/1986 | Krummel et al. | 315/225 |
| 4,620,271 | 10/1986 | Musil | 363/21 |
| 4,626,746 | 12/1986 | Zaderej | 315/208 |
| 4,631,450 | 12/1986 | Lagree et al. | 315/244 |
| 4,641,061 | 2/1987 | Munson | 315/210 |
| 4,647,817 | 3/1987 | Fähnrich et al. | 315/104 |
| 4,651,060 | 3/1987 | Clark | 315/199 |
| 4,677,345 | 6/1987 | Nilssen | 315/209 R |
| 4,682,083 | 7/1987 | Alley | 315/307 |
| 4,683,402 | 7/1987 | Aubrey | 315/56 |
| 4,700,113 | 10/1987 | Stupp et al. | 315/224 |
| 4,730,147 | 3/1988 | Kroening | 315/100 |
| 4,739,227 | 4/1988 | Anderson | 315/260 |
| 4,742,535 | 5/1988 | Hino et al. | 378/105 |
| 4,743,835 | 5/1988 | Bossé et al. | 323/266 |
| 4,857,806 | 8/1989 | Nilssen | 315/72 |
| 4,859,914 | 8/1989 | Summa | 315/354 |
| 4,864,482 | 9/1989 | Quazi et al. | 363/37 |
| 4,894,587 | 1/1990 | Jungreis et al. | 315/200 R |
| 4,933,605 | 6/1990 | Quazi et al. | 315/224 |
| 4,943,886 | 7/1990 | Quazi | 361/42 |
| 4,949,020 | 8/1990 | Warren et al. | 315/297 |
| 4,950,963 | 8/1990 | Sievers | 315/360 |
| 4,954,768 | 9/1990 | Luchaco et al. | 323/300 |
| 4,988,921 | 1/1991 | Ratner et al. | 315/159 |
| 4,996,462 | 2/1991 | Krummel | 315/209 R |
| 4,999,547 | 3/1991 | Ottenstein | 315/307 |
| 5,001,386 | 3/1991 | Sullivan et al. | 315/219 |
| 5,003,230 | 3/1991 | Wong et al. | 315/279 |
| 5,004,959 | 4/1991 | Nilssen | 315/291 |
| 5,004,972 | 4/1991 | Roth | 323/320 |
| 5,039,914 | 8/1991 | Szuba | 315/158 |
| 5,041,763 | 8/1991 | Sullivan et al. | 315/176 |
| 5,083,081 | 1/1992 | Barrault et al. | 324/126 |
| 5,084,653 | 1/1992 | Nilssen | 315/219 |
| 5,089,751 | 2/1992 | Wong et al. | 315/279 |
| 5,097,181 | 3/1992 | Kakitani | 315/209 R |
| 5,101,142 | 3/1992 | Chatfield | 315/308 |
| 5,172,033 | 12/1992 | Smits | 315/224 |
| 5,172,034 | 12/1992 | Brinkerhoff | 315/307 |
| 5,173,643 | 12/1992 | Sullivan et al. | 315/276 |
| 5,174,646 | 12/1992 | Siminovitch et al. | 362/218 |
| 5,175,477 | 12/1992 | Grissom | 315/291 |
| 5,185,560 | 2/1993 | Nilssen | 315/219 |
| 5,192,896 | 3/1993 | Qin | 315/224 |
| 5,194,782 | 3/1993 | Richardson et al. | 315/291 |
| 5,198,726 | 3/1993 | Van Meurs et al. | 315/224 |
| 5,214,356 | 5/1993 | Nilssen | 315/224 |
| 5,233,270 | 8/1993 | Nilssen | 315/58 |
| 5,237,243 | 8/1993 | Chung | 315/219 |
| 5,245,253 | 9/1993 | Quazi | 315/224 |
| 5,289,079 | 2/1994 | Wittman | 313/318 |
| 5,289,083 | 2/1994 | Quazi | 315/224 |
| 5,296,783 | 3/1994 | Fischer | 315/64 |
| 5,309,062 | 5/1994 | Perkins et al. | 315/53 |
| 5,313,142 | 5/1994 | Wong | 315/205 |
| 5,321,337 | 6/1994 | Hsu | 315/219 |
| 5,331,253 | 7/1994 | Counts | 315/209 R |
| 5,341,067 | 8/1994 | Nilssen | 315/209 R |
| 5,387,847 | 2/1995 | Wood | 315/209 R |
| 5,394,064 | 2/1995 | Ranganath et al. | 315/209 R |
| 5,396,154 | 3/1995 | Shiy et al. | 315/291 |
| 5,396,155 | 3/1995 | Bezdon et al. | 315/291 |
| 5,404,082 | 4/1995 | Hernandez et al. | 315/219 |
| 5,515,261 | 5/1996 | Bogdan | 363/89 |
| 5,559,395 | 9/1996 | Venkitasubrahmanian et al. | 315/247 |
| 5,596,247 | 1/1997 | Martich et al. | 315/56 |
| 5,608,295 | 3/1997 | Moisin | 315/247 |
| 5,677,602 | 10/1997 | Paul et al. | 315/224 |
| 5,686,799 | 11/1997 | Moisin et al. | 315/307 |
| 5,691,606 | 11/1997 | Moisin et al. | 315/307 |

THREE-WAY DIMMING BALLAST CIRCUIT WITH PASSIVE POWER FACTOR CORRECTION

BACKGROUND OF THE INVENTION

1. Field of the Invention

The present invention relates to improved apparatus and methods for operating fluorescent lamps and, in particular, to a method and apparatus to control the power delivered to a fluorescent lamp.

2. Description of the Prior Art

Fluorescent lamps are conventional types of lighting devices. They are gas charged devices which provide illumination as a result of atomic excitation of a low-pressure gas, such as mercury, within a lamp envelope. The excitation of the mercury vapor atoms is provided by a pair of heater filament elements mounted within the lamp at opposite ends of the lamp envelope. In order to properly excite the mercury vapor atoms, the lamp is ignited or struck by a higher than normal voltage. Upon ignition of the lamp, the impedance decreases and the voltage across the lamp drops to the operating level at a relatively constant current. The excited mercury vapor atoms emit invisible ultraviolet radiation which in turn excites a fluorescent material, e.g., phosphor, that is deposited on an inside surface of the fluorescent lamp envelope, thus converting the invisible ultraviolet radiation to visible light. The fluorescent coating material is selected to emit visible radiation over a wide spectrum of colors and intensities.

As is known to those skilled in the art, a ballast circuit is commonly disposed in electrical communication with the lamp to provide the elevated voltage levels and the constant current required for fluorescent illumination. Typical ballast circuits electrically connect the fluorescent lamp to line alternating current and convert this alternating current provided by the power transmission lines to the constant current and voltage levels required by the lamp.

Fluorescent lamps have substantial advantages over conventional incandescent lamps. In particular, the fluorescent lamps are substantially more efficient and typically use 80 to 90% less electrical power than incandescent lamps for an equivalent light output. For this reason, fluorescent lamps have gained use in a wide range of power sensitive applications.

SUMMARY OF THE INVENTION

In the present invention, a ballast circuit adjusts the dimming based on the output of a three-line, three-position switch. The ballast controls the level of brightness in response to a change in switch setting by adjusting the magnitude of the input voltage being delivered to the load. The ballast also, in response to a change in switch setting, changes the level of brightness of the lamp by controlling the operation of a switching transistor during a portion of the conductive cycle of the switching transistor to operate asymmetrically, thus providing a lower average power to the fluorescent lamp to dim its output. Ballast circuits constructed in accordance with the preferred embodiment of the invention achieve three different levels of dimming of the fluorescent lamp comparable to the operation of a three-way incandescent.

A further significant feature of the dimmable ballast circuit described above is that it requires only one single active stage to perform all the necessary functions of a ballast circuit, including lamp start-up, lamp driving operations, and local dimming of the lamp. The streamlined circuit design also provides for high electrical efficiency of the operating circuit because of the lack of additional parasitic active stages. Further, with the use of passive power factor correction, the resonant circuit provides for low total harmonic distortion and for high power factor correction, for example, achieving a power factor of greater than 0.95.

DETAILED DESCRIPTION OF THE PREFERRED EMBODIMENT

Ballast Circuit for the Three-Way Switch

Figure 1:
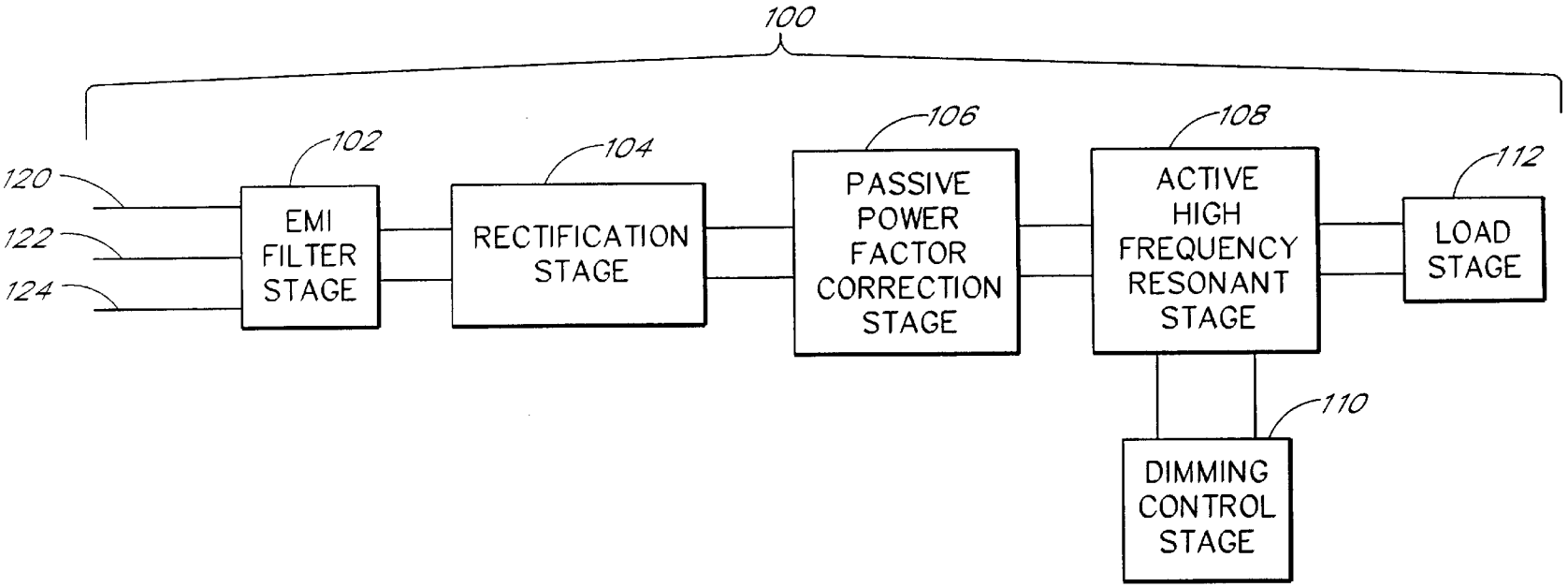
FIG. 1 is a block diagram of a ballast circuit of one embodiment of the present invention.

FIG. 1 is illustrates the ballast circuit 100 in accordance with one aspect of the present invention. The ballast circuit 100 comprises an EMI filter stage 102, a rectification stage 104, a passive power factor correction stage 106, an active high frequency stage 108, a dimming control stage 110 and a load stage 112. The ballast circuit 100 is adapted so that a compact fluorescent lamp connected at the load will dim appropriately depending on the setting of a three-way switch.

In a normal three-way incandescent light switch, three output wires, 120, 122, and 124 are available. One of the wires 120 is a neutral or return wire. A first hot wire 122 is connected to a low wattage filament, and a second hot wire 124 is connected to a high wattage filament. In an off state, neither the first hot wire 122 nor the second hot wire 124 is energized. In a first state, the light output of the lamp is at a minimum because only the first hot wire 122 is energized. In a second state, the lamp output is in a medium brightness stage because only the second hot wire 124 is energized and thus only the higher wattage filament is used. In a third stage, the light output of the lamp is at a maximum because both hot wires 122, 124 are energized and thus both filaments are in use.

Conventional three-way light dimmer switches are ubiquitous and are used, for example, in a number of table lamps for driving a screw-in 50-100-150 watt incandescent light bulb. A feature of this invention is that the same lamp base may be used to drive a compact fluorescent light driven by the ballast circuit 100 of FIG. 1.

The ballast circuit 100 in FIG. 1 adjusts the power delivered to a compact fluorescent light bulb such that three discrete levels of brightness are provided depending on which of the three input lines are energized. In the preferred embodiment, at least one of the discrete intensity levels is provided by reducing the rail voltage and at least one other discrete intensity level is provided by adjusting the amount of asymmetry in the described active stage. Thus, the circuit alters the fluorescent light output both by sending the information as to which line or lines are energized to the dimming control stage which adjusts the switching time of a transistor and by altering the rail voltage.

Figure 2:
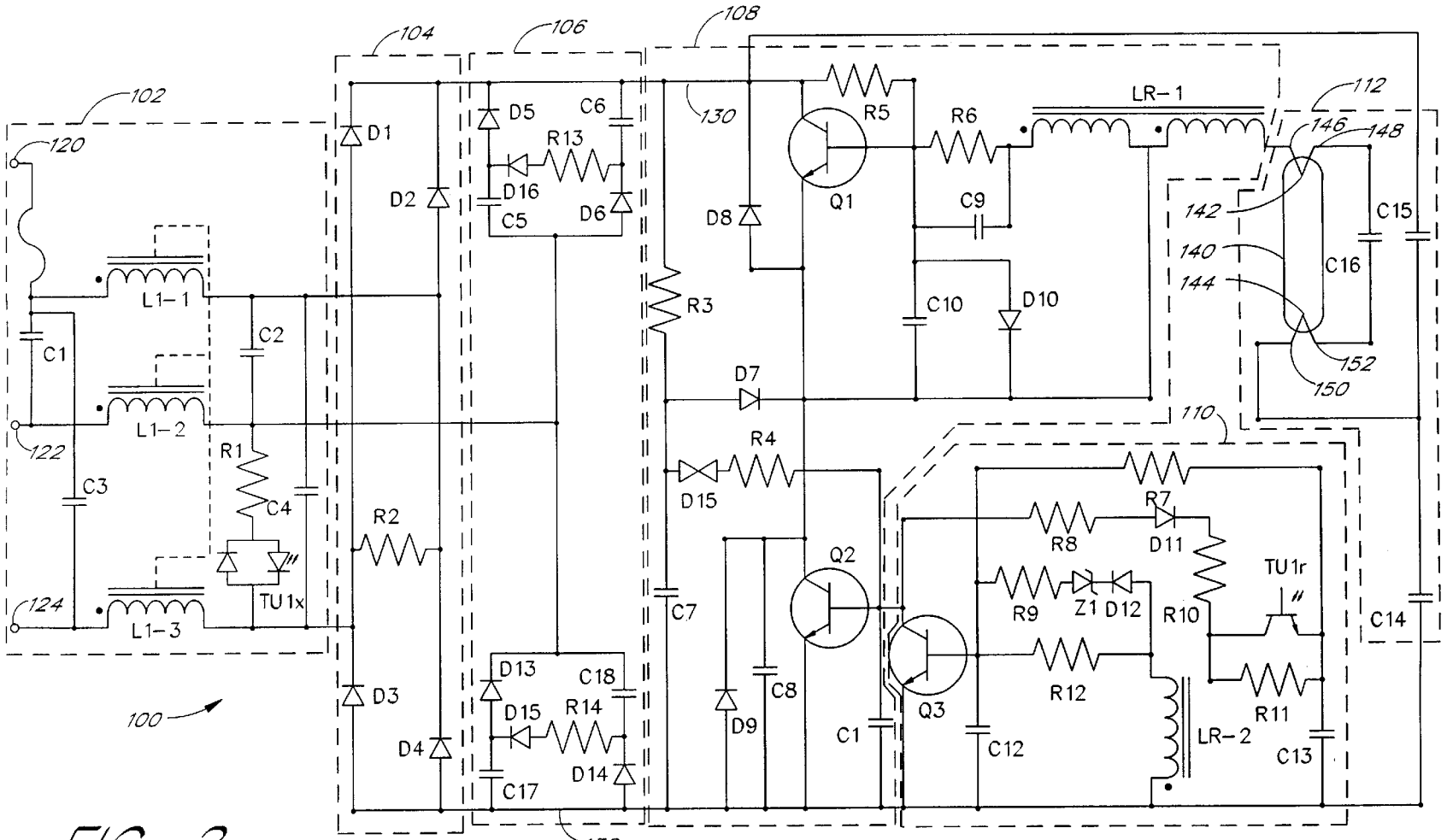
FIG. 2 is a schematic circuit diagram of a ballast circuit of the present invention.

FIG. 2 is a schematic representation of the ballast circuit of FIG. 1. Each stage of the ballast circuit 100 will be examined in detail below.

EMI Filter Stage 102

The EMI filter stage 102 supplies high voltage AC power to the ballast circuit 100. The EMI filter stage 102 comprises the high wattage input line 124, the low wattage input line 122, the neutral input line 120, a fuse F1, capacitors C1, C2, C3 and C4, a resistor R1, a photodiode or opto-coupler transmitter TU1*x* and inductors L1-1, L1-2 and L1-3. The neutral input line 120 is connected in series to a first terminal of the fuse F1. A second terminal of the fuse F1 is connected to a first terminal of the inductor L1-1, to a first terminal of the capacitor C1 and to a first terminal of the capacitor C3. A second terminal of the inductor L1-1 is connected to the anode of a diode D2, to the cathode of a diode D4, to a second terminal of a resistor R2, to a first terminal of the capacitor C2 and to a first t4erminal of the capacitor C4. In a specific circuit, the fuse F1 is advantageously formed as a fusible link on a printed circuit board (not shown). The low wattage input line 122 is connected to a first terminal of the inductor L1-2 and to a second terminal of the capacitor C1. A second terminal of the inductor L1-2 is connected to a second terminal of the capacitor C2, to the anode of a diode D14, to the cathode of a diode D13 and to a first terminal of the resistor R1. The high wattage input line 124 is connected to a second terminal of the capacitor C3 and to a first terminal of the inductor L1-3. A second terminal of the inductor L1-3 is connected to a second terminal of the opto-coupler transmitter TU1*x*, to a second terminal of the capacitor C4, to a first terminal of the resistor R2, to the anode of the diode D1 and to the cathode of the diode D3. The first terminal of the opto-coupler transmitter TU1*x* is connected to a second terminal of the resistor R1. The inductors L1-1, L1-2 and L1-3 are connected to the line voltages to protect the line against EMI by preventing high frequency signals from propagating to the lines 120, 122 and 124.

In the preferred embodiment, each of the inductors L1-1, L1-2 and L1-3 is a 0.5 millihenry inductor. The capacitors C1 and C3 are 0.01 microfarad capacitors rated at 400 volts, and the capacitors C2 and C4 are 0.1 microfarad capacitors rated at 250 volts. The resistor R1 is a 33kΩ resistor, and the opto-coupler transmitter TU1*x* is a H11AA1 transmitter.

The Rectification Stage 104

The rectification stage 104 converts the input AC voltage to a DC voltage and includes rectifying diodes D1, D2, D3 and D4 and a current limiting resistor R2. The anode of the diode D1 is connected to the cathode of the diode D3, to the first terminal of the resistor R2, to the second terminal of the capacitor C4, to the second terminal of the opto-coupler transmitter TU1*x* and to the second terminal of the inductor L1-3. The cathode of the diode D1 is connected to the positive voltage rail 130. The anode of the diode D3 is connected to the negative voltage rail 132. The anode of the diode D2 is connected to the cathode of the diode D5, to a second terminal of the resistor R2, to the first terminal of the capacitor C4, to the first terminal of the capacitor C2 and to a second terminal of the inductor L1-1. The cathode of the diode D2 is connected to the positive voltage rail 130. The anode of the diode D4 is connected to the negative voltage rail 132. The rectification stage 104 converts the input line voltage of the EMI filter stage 102 into DC voltage between the positive voltage rail 130 and the negative voltage rail 132.

In a specific embodiment, the components of the rectification and voltage amplification stage 104 have the following values: the rectifying diodes D1, D2, D3 and D4 are preferably 1N4005 diodes, and the current limiting resistor R2 is approximately 51 KΩ and is rated at ½ watt.

The Passive Power Factor Correction Stage 106

The passive power factor correction stage 106 provides for a passive power factor correction for the ballast circuit 100 and includes four capacitors C5, C6, C17 and C18, six diodes D5, D6, D13, D14, D15 and D16, and two resistors R13 and R14. The cathode of the diode D5 is connected to the positive voltage rail 130, and the anode of the diode D5 is connected to the cathode of the diode D16 and to a first terminal of the capacitor C5. The anode of the diode D16 is connected to a first terminal of the resistor R13. A second terminal of the resistor R13 is connected to a second terminal of the capacitor C6 and to the cathode of the diode D6. A first terminal of the capacitor C6 is connected to the positive voltage rail 130. The anode of the diode D13 is connected to the cathode of the diode D15 and to a first terminal of the capacitor C17. A second terminal of the capacitor C17 is connected to the negative voltage rail 132. The anode of the diode D15 is connected to a first terminal of the resistor R14. A second terminal of the resistor R14 is connected to a second terminal of the capacitor C18 and to the cathode of the diode D14. The anode of the diode D14 is connected to the negative voltage rail 132.

Figure 3:
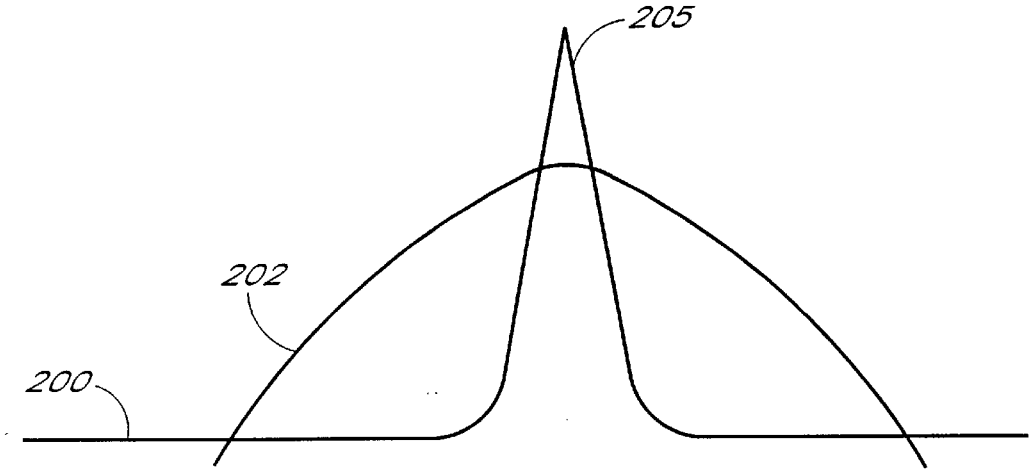
FIG. 3 (PRIOR ART)
FIG. 3 is a graphical representation of current and voltage waveform patterns generated by prior art ballast circuits.

By using the passive power factor correction stage 106 in the circuit, the power factor can be improved to approximately 0.95 without the use of a boost circuit. The increased power factor results in a significant energy cost savings for the overall ballast circuit 100. The passive power factor correction stage 106 receives a voltage from both the positive voltage rail 130 and the negative voltage rail 132. A portion of the voltage received from the positive voltage rail is graphically depicted in FIG. 3 as a half sine wave 202. If a standard storage capacitor were used in place of the passive power factor correction stage 106, the resultant current delivered to the remainder of the ballast circuit 100 would be approximated by waveform 200. Because the current surges only during the peak of the voltage cycle 202, a high peak current 205 results which causes a low power factor on the order of 0.60.

Figure 4:
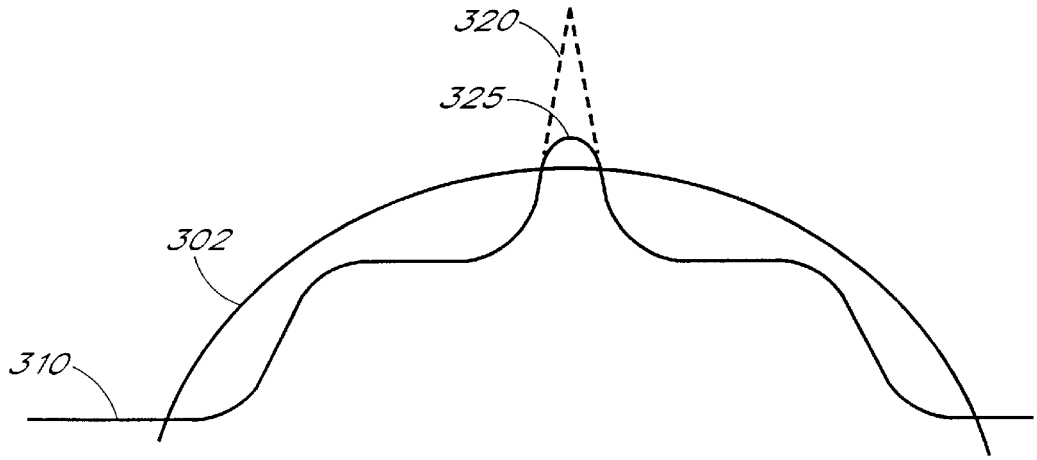
FIG. 4 is a graphical representation of current and voltage waveform patterns generated by the ballast circuit of FIG. 2.

By using the passive power factor correction stage 106 instead of storage capacitors, the power factor is improved significantly. A current received from the positive voltage rail 130 first charges the capacitor C6, passes through the resistor R13 and the diode D16, charges the capacitor C5 and then returns to the line. Thus, the capacitors C5 and C6 are charged in series. When the voltage on the positive voltage rail passes below a threshold voltage, the diodes D5 and D6 turn on and the capacitors C5 and C6 begin to discharge. With the diodes D5 and D6 on, the capacitors C5 and C6 discharge in parallel. Because a sinusoidal waveform is applied to the passive power factor correction stage 106, this cycle is constantly repeated resulting in a current waveform 310 as shown in FIG. 4. The current waveform 310 in FIG. 4 more closely approximates the input waveform 302 and has a resultant power factor about 0.95. The total harmonic distortion (THD) of the waveform is also improved, especially due to the use of the resistor R13. By using the resistor R13, the peak charging current is smoothed out resulting in the peak 325 shown in FIG. 4. By removing the resistor R13, the peak charging current will tend to spike giving a resultant waveform 320 shown in phantom. With the resistor R13 smoothing out the peak charging current, the THD can be maintained at less than 0.20.

The lower section of the passive power factor correction stage 106 containing the capacitors C17 and C18 performs the identical function described above, only for the negative portion of the input waveform 202.

In the preferred embodiment, the capacitors C5, C6, C17 and C18 are 33 microfarad capacitors rated at 200 volts. The diodes D5, D6, D13, D14, D15 and D16 are preferably 1N4005 diodes. The resistors R13 and R14 are 33Ω resistors and are rated at 3 watts.

The Active High Frequency Resonant Stage 108

As further illustrated in FIG. 2, the high frequency resonant stage 108 provides the high frequency required to properly drive the lamps. The high frequency resonant stage 108 comprises resistors R3, R4, R5 and R6, capacitors C7, C8, C9, C10 and C11, diodes D7, D8, D9, and D10, a diac D15, a split inductor LR-1, and a pair of transistors Q1 and Q2. A first terminal of the resistor R3 is connected to a first terminal of the capacitor C7, to a first terminal of the diac D15, and to the anode of the diode D7. A second terminal of the resistor R3 is connected to the positive voltage rail 130. A second terminal of the capacitor C7 is connected to the negative voltage rail 132. The cathode of the diode D7 is connected to the anode of the diode D8, to the emitter of the transistor Q1, to a second terminal of the capacitor C10, to the cathode of the diode D10, a split in the inductor LR-1, the collector of the transistor Q2, to a first terminal of the capacitor C8, and to the cathode of the diode D9. The anode of the diode D9 is connected to the negative voltage rail 132. A second terminal of the capacitor C8 is connected to the negative voltage rail 132. The cathode of the diode D8 is connected to the positive voltage rail 130. The collector of the transistor Q1 is connected to the positive voltage rail 130. The base of the transistor Q1 is connected to a second terminal of the resistor R5, to a first terminal of the resistor R6, to a first terminal of the capacitor C9, to a first terminal of the capacitor C10, and to the anode of the diode D10. A first terminal of the resistor R5 is connected to the positive voltage rail 130. A second terminal of the resistor R6 is connected to a second terminal of the capacitor C9 and to a first terminal of the inductor LR-1. A second terminal of the inductor LR-1 is connected to the lamp load. The base of the transistor Q2 is connected to a first terminal of the capacitor C11, to a first terminal of a resistor R8, to the collector of transistor Q3, and to a second terminal of resistor R4. A first terminal of resistor R4 is connected to a second terminal of the diac D15. A second terminal of capacitor C11 is connected to the negative voltage rail 132.

In the preferred embodiment, the components of the resonating stage 108 have the following values: the transistors Q1 and Q2 are BUL45 transistors, the diodes D8 and D9 are UF4005 diodes, the diode D7 is a 1N4005 diode, the diode D10 is a 1N4148 diode, the diac D15 is a HT-32 diac, the capacitor C7 is a 0.1$\mu$F capacitor rated at 100 volts, the capacitor C8 is a 0.001 $\mu$F capacitor rated at 1000 volts, the capacitor C9 is a 0.01 $\mu$F capacitor rated at 50 volts, the capacitors C10 and C11 are 0.1 $\mu$F capacitors rated at 50 volts, the resistors R3 and R5 are 440 KΩ resistors, the resistor R4 is a 47Ω resistor, the resistor R6 is a 62Ω resistor and is rated at 2 watts and LR-1 is a 1.4 millihenry inductor having 3 turns on the first section and 150 turns on the second section.

Starter Circuit and Start Mode of Operation

The capacitor C7, the diac D15 and the current limiting resistor R4 form a starter circuit that initially, at the application of power to the ballast circuit 100, actuates or turns ON the circuit transistor Q2 in the active resonant stage 108.

During the start mode of the active resonant stage 108, the switching transistor Q2 is actuated by the starter circuit. Specifically, when the capacitor C7 charges to a voltage greater than the reverse breakdown voltage of the diac D15, the diac D15 discharges through the current limiting resistor R4, turning ON the transistor Q2. Once the transistor Q2 is turned on, the switching transistors Q1 and Q2 alternately conduct during each half cycle of the input voltage and are driven during normal circuit operation by energy stored in the second section of the inductor LR-1 and transferred to the secondary windings of the first section of LR-1 and to an inductor LR-2. Therefore, the starter circuit only operates during initial start mode and is not required during the normal operation of the resonant stage 108.

Resonant Mode of Operation

With further reference to FIG. 2, during normal or resonant operation, the ballast circuit 100 is energized by the application of the sinusoidal input voltage having a selected magnitude and frequency to the input power lines 120, 122 and 124. In the typical embodiment for European Countries and other countries where the standard voltage is 220 volts, the input power has a magnitude of 220 volts. The input voltage is filtered by the EMI filter stage 102, as described above, and produces an input current flow to the rectification stage 104 and to the passive power factor correction stage 106. The output of the passive power factor correction stage 106 is used to power the remainder of the circuit.

When the transistor Q1 is on, current flows from the emitter of the transistor Q1 to the second section of the inductor LR-1, through the lamp 140 and the capacitor C16, through the capacitor C14 to the negative voltage rail 132. When the transistor Q1 turns off and the transistor Q2 turns on, current flows from the collector of the transistor Q2 to the second section of the inductor LR-1, through the lamp 140 and the capacitor C16, through the capacitor C15 to the positive voltage rail 130. When used in combination in the ballast circuit 100, these components produce a current having a selected elevated frequency, preferably greater than 20 Kilohertz, and most preferably around 40 Kilohertz, during normal operation of the ballast circuit. This high-frequency operation reduces hum and other electrical noises delivered to the lamp load. Additionally, high-frequency operation of the lamp load reduces the occurrence of annoying flickering of the lamp. The capacitors C14 and C15 close the high frequency path back to the DC high and low side.

The Dimming Control Stage 110

The dimming control stage 110 comprises a transistor Q3, resistors R7, R8, R9, R10, R11 and R12, capacitors C12 and C13, diodes D11 and D12, a zener diode Z1, and an opto-coupler receiver TU1*r*. The emitter of the transistor Q3 is connected to the negative voltage rail 132 and the collector of the transistor Q3 is connected to a first terminal of the resistor R8. The base of the transistor Q3 is connected to a first terminal of the capacitor C12, to the first terminal of the resistor R12, to the first terminal of the resistor R9 and to the first terminal of the resistor R7. A second terminal of the capacitor C12 is connected to the negative voltage rail 132. A second terminal of the resistor R7 is connected to a second terminal of the opto-coupler receiver TU1*r*, to a second terminal of the resistor R11, and to a first terminal of the capacitor C13. A second terminal of the capacitor C13 is connected to the negative voltage rail 132. A second terminal of resistor R8 is connected to the anode of the diode D11. The cathode of the diode D11 is connected to a first terminal of the resistor R10. A second terminal of the resistor R10 is connected to a first terminal of the opto-coupler receiver TU1*r* and to a first terminal of the resistor R11. A second terminal of the resistor R9 is connected to the anode of the zener diode Z1. The cathode of the zener diode Z1 is connected to the cathode of the diode D12. The anode of the diode D12 is connected to a second terminal of the resistor R12 and to a first terminal of the inductor LR-2. A second terminal of the inductor LR-2 is connected to the negative voltage rail 132.

In the preferred embodiment, the elements in the dimming control stage 110 have the following values: the transistor Q3 is a 2N3904 transistor, the diodes D11 and D12 are 1N4148 diodes, the zener diode Z1 is a 1N52378 diode, the opto-coupler receiver is a H11AA1 receiver, the capacitor C12 is a 0.01 $\mu$F capacitor rated at 50 volts, the capacitor C13 is a 33 $\mu$F capacitor rated at 35 volts, the resistor R7 is a 3 KΩ resistors, the resistor R8 is a 62Ω resistor and is rated at 2 watts, the resistor R9 is a 619Ω resistor, the resistor R10 is a 820Ω resistor, the resistor R11 is a 10 KΩ resistor, the resistor R12 is a 1.37KΩ resistor and the inductor LR-2 is 3 turns of the 1.4 millihenry inductor.

The Load Stage 112

The load stage 112 comprises a lamp load 140 with filaments 142, 144, filament terminals 146, 148, 150 and 152 and capacitors C14, C15 and C16. A first end of the filament 142 is connected to the filament terminal 146. A second end of the filament 142 is connected to the filament terminal 148. A first end of the filament 144 is connected to the filament terminal 150 and a second end of the filament 144 is connected to the filament terminal 152. The first filament 142 is located at one end of the lamp load 140, and the second filament 144 is located at the opposite end of the lamp load 140. The filament terminal 146 is connected to the second terminal of the inductor LR-1. The filament terminal 148 is connected to a first terminal of the capacitor C16. A second terminal of the capacitor C16 is connected to the filament terminal 152. The filament terminal 150 is connected to a second terminal of the capacitor C15 and to a first terminal of the capacitor C14. A first terminal of the capacitor C15 is connected to the positive voltage rail 130. A second terminal of the capacitor C14 is connected to the negative voltage rail 132.

The resonating storage capacitor C8 stores a selected elevated voltage, preferably equal to or greater than 300 volts rms, which is required to start or ignite the fluorescent lamp mounted between the filament terminals 146, 148, 150 and 152. Once the lamp 140 is struck, the circuit operating voltage is reduced to a value slightly greater than the input voltage, preferably around 100 volts rms. As stated above, the capacitors C15 and C14 close the high frequency path back to the DC high and low side respectively.

In the preferred embodiment, the capacitor C16 is a 0.0033 $\mu$F capacitor rated at 800 volts, and the capacitors C14 and C15 are 0.033 $\mu$F capacitors rated at 250 volts.

MODES OF OPERATION

The Second State, Medium Intensity Light

The intensity of light output by the fluorescent lamp depends on which line is energized.

In the second state, or medium light intensity state, the high wattage line 124 is energized and the low wattage line 122 is off. When the line 124 is on, the diode D1 conducts during the positive half cycle, and the diode D3 conducts during the negative half cycle. Thus, the diode D1 provides power to the passive power factor correction stage 106 during the positive half cycle, and the diode D3 provides power during the negative half cycle. The voltage amplification (i.e. voltage doubling) performed by the rectification stage 104 in this embodiment is approximately 2:1. That is, the output voltage of the rectification stage 104 is approximately two times the peak AC input voltage.

When the line 124 is energized, a small current also flows through the resistor R2. The value of this current is approximately 2 mA. This small current is sufficient to charge the capacitor C4 and to generate a small current through the resistor R1 and the opto-coupler transmitter TU1*x*. This current is sufficient to turn on the opto-coupler transmitter TU1*x*. The signal from the opto-coupler transmitter TU1*x* is received by the receiving transistor of the opto-coupler TU1*r* in the control stage 110. The signal from the opto-coupler transmitter TU1*x* turns on the opto-coupler receiver TU1*r* which charges the capacitor C12. As the capacitor C13 is charged, current flows through the resistor R12. The base voltage of the transistor Q3 rises and turns the transistor Q3 on. When the transistor Q3 is on, the base of the transistor Q2 is kept off. When the transistor Q2 is off, the frequency period is shortened and less power is delivered to the load. In this energized state, approximately 50% of full light intensity is delivered by the fluorescent bulb.

The First State, Minimum Intensity Light

In the first state, where the light output of the lamp is at a minimum, the low wattage line 122 is energized and the high wattage line 124 is off. The diodes D1, D2, D3 and D4 now act as a full bridge rather than as a voltage doubler. Thus, when only the line 122 is energized, no voltage doubling takes place, and the voltage across the rails is approximately one-half of the voltage during the second state. The reduction in light intensity resulting from the reduction in rail voltage alone is approximately 60% of the total light output.

When the line 122 is energized, a residual current travels through the resistor R1, through the opto-coupler transmitter TU1*x*, through the resistor R2, and through the inductor L1-1 to the neutral terminal 120. This residual current turns on the optical transmitter TU1*x* and the optical receiver TU1*r* slightly to charge the capacitor C13. The current through the resistor R7 charges the capacitor C12, which turns on the transistor Q3, which turns off the transistor Q2. Because the residual current through the opto-coupler transmitter TU1*x* is small, the current from the opto-receiver TR1*r* is less than the current provided by the opto-receiver when the three-way switch is set at the medium setting. Thus, the transistor Q3 will not always be on. Instead, the on time and off time of the transistor Q3 will be determined by the capacitor charge and discharge times. Compared to a symmetric duty cycle, the net reduction in light output that results from the change in duty cycle from the active stage operating symmetrically (the transistor Q3 always off) is approximately 20% of the total light output.

Thus in the minimum light output stage, the total reduction in light intensity from the maximum output is 80% (i.e., the total light output is approximately 20% of the maximum light output).

Both Line 122 and Line 124 Energized Maximum Light Output

In the third switch position, both the lines 122 and 124 are energized. The voltage across the rail voltages will again be twice the input voltage because the voltages across the rails is determined by the input line voltage and by the voltage drop across the diode D1 in the positive half cycle and across the diode D3 in the negative half cycle. Thus, the voltage across the rail provides maximum power to the lamp.

Likewise, the dimmer control circuit 110 also will provide maximum power to the lamp. When the lines 122 and 124 are both energized, the photo-coupler or optocoupler transmitter TU1*x* is shorted out of the circuit. Since the opto-coupler transmitter is off, the opto-coupler receiver TU1*r* will also remain off, and thus the capacitor C13 will not be charged. The transistor Q3 will be kept off because the base emitter voltage will be less than the turn on voltage of the transmitter Q3. With the transistor Q3 kept off, the transistor Q2 will be turned on and will deliver the full duty cycle or the maximum available power to the load.

Numerous variations and modifications of the invention will become readily apparent to those skilled in the art. Accordingly, the invention may be embodied in other specific forms without departing from its spirit or essential characteristics. The detailed embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A ballast for use with a compact fluorescent lamp, said ballast comprising:

an EMI filter stage receiving an AC voltage input, wherein the AC voltage input is supplied by a three-line input from a three-way switch, said three-way switch having an off setting as well as a first or low on setting, a second or medium on setting, and a third or high on setting, wherein said ballast provides at least three discrete stages of dimming corresponding to said first, second and third on settings of the three-way switch;

a rectification stage connected to the EMI filter stage, the rectification stage converting the AC voltage to a DC voltage;

a passive power factor correction stage receiving the DC voltage from the rectification stage and generating a corrected signal, wherein the passive power factor correction stage comprises a plurality of diodes and a plurality of capacitors, wherein the diodes and the capacitors are connected so the capacitors charge in series and discharge in parallel;

a high frequency resonating stage receiving the corrected signal from the passive power factor correction stage and generating a high frequency signal;

a load stage receiving the high frequency signal from the resonating stage, wherein the load stage applies the high frequency signal to light the compact fluorescent lamp; and a dimming stage which controls the high frequency resonating stage to adjust the symmetry of the high frequency signal, thereby reducing the power supplied to the load stage;

wherein the EMI filter stage includes an opto-coupler transmitter and the dimming stage includes an opto-coupler receiver, the opto-coupler transmitter set to turn on when the three-way switch is set to either the low on setting or the medium on setting, and wherein the opto-coupler receiver is arranged to receive a signal from the opto-coupler transmitter, the opto-receiver responding to said signal to drive a current which causes the resonating stage to operate asymmetrically.

* * * * *